United States Patent [19]

Silvestrini et al.

[11] Patent Number: 4,505,670

[45] Date of Patent: Mar. 19, 1985

[54] APPARATUS FOR MOVING AND THERMALLY CONDITIONING CYLINDRICAL CONTAINERS

[75] Inventors: Jesus A. Silvestrini; Juan C. Morsucci, both of Mendoza, Argentina

[73] Assignee: Imdec S.R.L, Mendoza, Argentina

[21] Appl. No.: 585,409

[22] Filed: Mar. 2, 1984

[30] Foreign Application Priority Data

Mar. 2, 1983 [AR] Argentina ..... 292275

[51] Int. Cl.[3] ..... F27B 9/14

[52] U.S. Cl. ..... 432/124; 432/239

[58] Field of Search ..... 432/121, 122, 124, 239

[56] References Cited

U.S. PATENT DOCUMENTS

| | | | |
|---|---|---|---|
| 1,979,697 | 11/1934 | Maring | 432/124 |
| 2,050,012 | 8/1936 | Meyer | 198/127 |
| 2,607,698 | 8/1952 | Martin | 99/214 |
| 3,917,445 | 11/1975 | Suva et al. | 432/124 |
| 4,384,463 | 5/1983 | Rica et al. | 62/374 |
| 4,403,954 | 9/1983 | Kokeguchi et al. | 432/124 |

*Primary Examiner*—John J. Camby

*Attorney, Agent, or Firm*—Duckworth, Allen, Dyer & Pettis

[57] ABSTRACT

Apparatus is disclosed for moving and thermally conditioning generally cylindrical containers in which the structure provides for movement of the containers about their axes and provides for a predetermined heat flow relative to the containers to change the temperature of the containers by a predetermined amount.

28 Claims, 12 Drawing Figures

APPARATUS FOR MOVING AND THERMALLY CONDITIONING CYLINDRICAL CONTAINERS

BACKGROUND OF THE INVENTION

In the food processing and canning industry there has long been a requirement for heating and cooling the canned product. This same requirement exists for bulk packaging of such foods, as in drums of two hundred liters, or fifty-five gallons or thirty gallons. To sterilize such a food product properly in a sealed container, it is necessary that the container be agitated at the same time that heat is applied to its exterior. Subsequent to the sterilization process, it is necessary to cool the container for subsequent handling and storage.

Various types of equipment have long existed for such thermal conditioning of smaller containers, such as those of five gallons or less. Exemplary of such equipment is that shown in U.S. Pat. No. 2,607,698 to Martin. In such prior art equipment a suitable conveyer has generally rolled the containers along a platform while shaking them and spraying them with a fluid of appropriate temperature. However, much of this equipment has been limited in its usefulness to relatively small containers. Much of this equipment is designed such that its strength is inherently insufficient to handle large containers, such as drums. Other such equipment suitable for handling drums is limited in its usefulness by being capable of handling containers of only one size, thus requiring costly duplication of equipment or time-consuming conversions.

SUMMARY OF THE INVENTION

It is an object of the present invention to provide an apparatus for moving and thermally conditioning generally cylindrical containers that overcomes the disadvantages of the prior art equipment. It is a further object of the invention to provide such apparatus that is rugged and durable and can provide for substantially continuous operation. It is yet another object of the invention to provide such equipment that is capable of handling different sizes of containers without changes in the apparatus.

To achieve the foregoing, as well as other objects that will become apparent to those skilled in the art, apparatus for moving and thermally conditioning generally cylindrical containers is disclosed that includes mounting structure, container support apparatus fixedly connected to the mounting structure, container moving apparatus carried by the mounting structure, and structure for effecting a predetermined heat flow relative to a container carried by the apparatus to change the temperature of such a container by a predetermined amount. The container support apparatus is mounted in a manner to selectively engage each container introduced to the apparatus at predetermined positions, with the cylindrical axis of such a container in a generally horizontal position. The container moving apparatus is selectively movable relative to the container support apparatus between a first vertical position carrying such a container out of engagement with the support apparatus and a second vertical position permitting engagement between the container and the support apparatus. This container moving apparatus includes a portion that is selectively movable relative to the cylindrical sidewall of such a container, whereby the relative motion between the container and the container moving apparatus, when in carrying engagement therewith, will effect a rotational movement of the container about its axis.

DESCRIPTION OF THE DRAWINGS

To illustrate further the principles of this invention, preferred embodiments will be described in detail in which.

DESCRIPTION OF PREFERRED EMBODIMENTS

Figure 1:
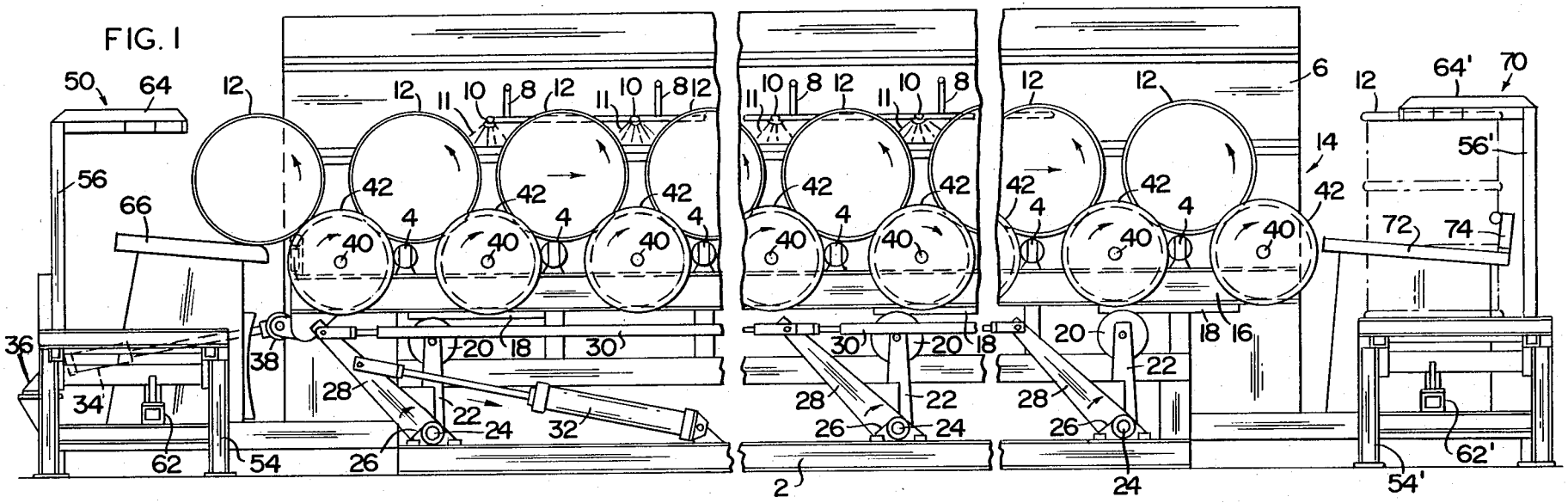
FIG. 1 is a side elevation of the moving and thermally conditioning apparatus of this invention.
Figure 2:
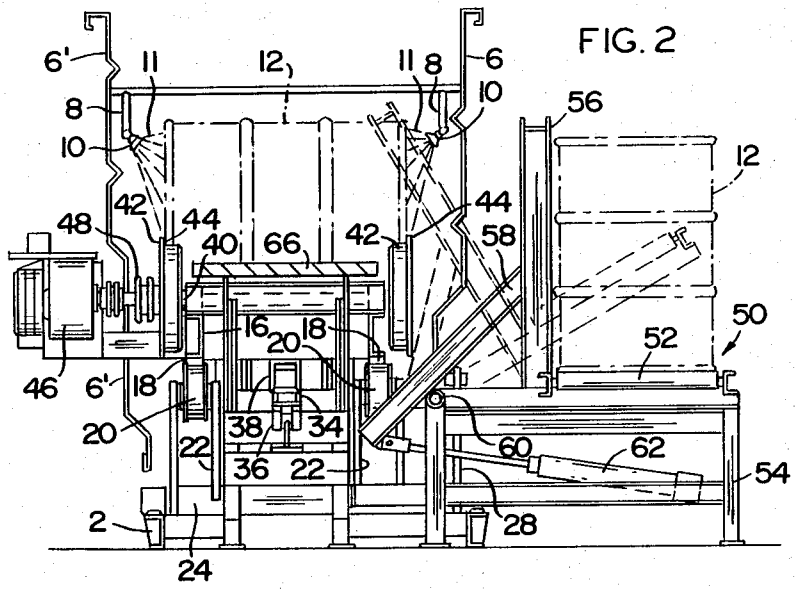
FIG. 2 is a front elevational view of the apparatus of FIG. 1.

A particularly preferred embodiment of the container moving and thermally conditioning apparatus of this invention is illustrated in the elevational view of FIGS. 1 and 2. This apparatus comprises, generally, mounting means in the form of support frame 2 to which are fixedly connected container support means 4, a two-sided enclosure comprised of walls 6 and 6' and container moving means that will be described below. Suitably mounted to the enclosure wall 6 and 6' are fluid spray means comprising appropriate plumbing 8 and spray heads 10 providing for fluid flows or sprays 11.

Figure 3:
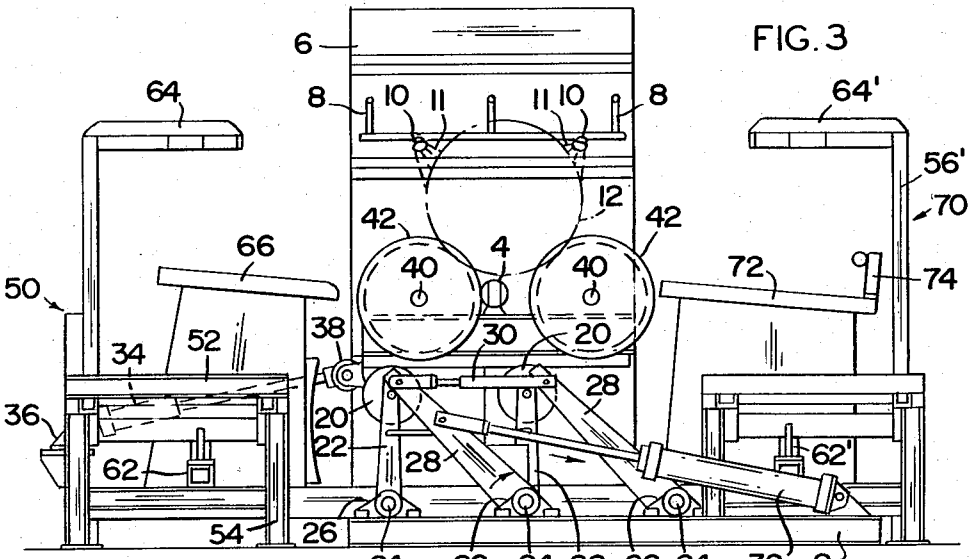
FIG. 3 is a side elevational view of a truncated, single station version of the apparatus of FIG. 1.

In FIG. 3 is illustrated a variation of the apparatus of this invention in which the apparatus of FIGS. 1 and 2 is truncated to provide for a substantially shortened apparatus. This truncated apparatus functions in substantially the same manner as that of FIGS. 1 and 2 and provides for substantially the same benefits. Accordingly, corresponding components of the apparatus of FIG. 3 are given reference numbers corresponding identically to those similar components of the apparatus of FIGS. 1 and 2.

Shown in FIGS. 1 and 2 are a plurality of generally cylindrical containers 12. The containers in FIG. 1 are shown with their cylindrical axes oriented in a generally horizontal direction. These containers 12 are moved through the apparatus of FIG. 1 from left to right and also rotated about their cylindrical axes by the container moving means generally indicated by reference number 14. This container moving means is carried by the mounting frame 2 and includes chassis means 16, which may be fabricated of suitable material, such as steel channel, and to the lower surfaces of which are attached guide rails 18. The guide rails 18, and thus the chassis 16, are supported on skidding wheels 20 that are rotatably carried upon support arms 22. Support arms 22 suitably may be pivotally mounted to the support frame 2 by being pinned or otherwise fixedly connected to lifting shafts 24 carried in journals 26 affixed to the support frame 2. Also fixedly connected to the lifting shafts 24 may be actuating arms 28 that are linked together by suitable joining members 30. Operatively connected to the actuating arms 28 is a selectively operable actuating device, suitably in the form of hydraulic cylinder 32, the opposite end of which may be connected to the mounting frame 2 as shown in FIG. 1. Suitable hydraulic controlling apparatus, which may be in the form of electrically operated valves, pumps, hydraulic reservoirs and controllers, all of which are well known to those skilled in the art, may suitably be provided for controlling this cylinder as well as the horizontal actuating cylinder 34 described below.

This apparatus, including the above described components 20 through 32, provides for selectively operable vertical movement of the chassis 16 between various vertical positions, in a manner to be described below.

Suitably connected to one end of the chassis 16 are additional actuating means for selectively effecting horizontal movement of the container moving means. This horizontal actuating means may suitably include an additional selectively operable hydraulic cylinder 34 (shown in phantom in FIGS. 1 and 3) connected to the mounting frame 2 by an appropriate mount 36 and to chassis 16 by an appropriate clevis connection 38.

Rotatably mounted to the chassis 16 are container engaging the rotating means, suitably in the form of a plurality of shafts 40 carried in journals (not shown) affixed to the chassis 16. Each of these shafts has a plurality of radially enlarged portions, such as wheels 42, affixed suitably adjacent opposite ends thereof. These wheels 42 preferably include radially outwardly extending flange portions 44. The wheels 42 are affixed to, and thus effectively form a portion of, shafts or members 40.

As shown in FIGS. 1 and 3, adjacent shafts or members 40 with their radially enlarged portions or wheels 42 are positioned such that the mutually closest portions thereof (the peripheries of wheels 42) are spaced apart a horizontal distance less than the diameter of a container 12 to be conditioned by the apparatus. Thus, such a container 12, in the position of the apparatus shown in FIGS. 1 through 3, will be supported on those members 40 by their respective wheels 42. As shown, the containers 12 will, in that situation, be supported out of engagement with the supporting means 4 that are fixedly connected to the mounting frame 2. The movement of the chassis and thus of the entire container moving means in generally vertical and horizontal directions will be described in detail below.

In addition to the generally vertical and horizontal movement to be described below, the container moving means also provides for rotational movement of containers carried thereby. This is provided for by the rotational drive 46, suitably mounted to chassis 16 and connected through appropriate shafts, gears or chain drives 48 to each of the members 40 and their associated wheels 42. This rotational drive 46 provides, in the conventional manner, for selective movement of the members 40 and their wheels 42 relative to the cylindrical sidewalls of any container 12 engaged by such container moving means. This relative movement between the supporting wheels 42 and the container 12 cylindrical sidewalls at their points of engagement therewith thus provides for tangential relative movement between each such container 12 and the wheels 42 comprising a portion of the container engaging and rotating means to effect a rotational movement of the container 12 about its axis, in the direction shown by the respective arrows in FIG. 1. The rotational drive 46 suitably includes a drive motor, and a variable speed drive for controlling the speed of rotation of the containers 12 according to the product contained. If desired, a plurality of such rotational drives 46 may be provided, connected to different sets of shafts 40 and wheels 42, such that different speeds of rotation of the containers 12 may be effected in different portions of the apparatus.

As shown in FIGS. 1 through 3 the wheels 42 and their radially outwardly extending flanges 44 are preferably positioned such that the flange portions 44 are axially outside the respective axial ends of a container supported thereby. Thus, the flanges serve to restrain any axial movement of the container during the time it is engaged with the wheels 42.

At one side of the structure described above, the left side in FIGS. 1 and 3, is positioned container introducing means, generally indicated by reference number 50, for receiving from a previous location a container 12 to be thermally conditioned. As shown in FIG. 2, such a container 12 is received on a platform 52. This platform 52 may suitably comprise a plurality of coplanar rollers 52 rotatably mounted to a dumping frame 56 that is affixed to support 58 and pivotally mounted to frame 54 by shaft and journal arrangement 60. Dumping frame 56 includes at its top an appropriate cradle member 64 to support a drum 12 during this pivoting to restrain it from falling away from the frame. Connected to the end of support 58 opposite the dumping frame 56 is one end of an actuator 62 that may suitably be a selectively controlled hydraulic cylinder. As shown by the dotted line representation in FIG. 2, selective retraction of the shaft of actuator 62, conventionally under the control of suitable electronic control and valving arrangements, effects a counterclockwise pivoting of the support member 58 and the dumping frame 56 about pivot 60.

As the dumping frame 56 and its supported container 12 are pivoted about 90 degrees (counterclockwise in FIG. 2) the container 12 will be moved from its initial position with its cylindrical axis generally vertical to the position shown in FIG. 2 with the container cylindrical axis generally horizontal. This movement also will serve to lay the container 12 upon the slanted platform 66 from whence it may roll free as shown in FIG. 1 into contact with the first pair of wheels 42. At that point the dumping frame 56 may then be pivoted by actuator 62 back to its original position to receive another container 12 for introduction into the apparatus.

At a second side of the apparatus, suitably at the opposite end in this linear configuration, is provided container removal means, generally indicated by reference numeral 70. In these preferred embodiments such container removal means may suitably be of substantially similar configuration and manner of operation as those of container introducing means 50 described above. Because of the similarity of components, corresponding reference numerals 52' through 64' are utilized for corresponding components.

In the operation of container removal means the dumping frame 56' is initially in a horizontal position with the shaft of cylinder 62' fully retracted within the cylinder. Then, as a container 12 moves (to the right in FIGS. 1 and 3) from the last pair of wheels 42, that container 12 will roll down the inclined support 72 to rest against the stop 74, with the container axis horizontal. At that point the selective valving can be actuated to effect extension of the shaft of cylinder 62' to pivot the dumping frame 56' into its upright position, thereby lifting the container 12 from the inclined support 72 and moving it to the position generally shown in FIG. 2, with the container axis generally vertical. At this point the container may then be removed from the apparatus for further handling or storage.

With the apparatus as described above, the method of movement of the container moving means and thus of a container 12 through the apparatus may be described with respect to the schematic representations of FIGS. 4 through 8. In each of the FIGS. 4 through 7 the dark, bold arrows indicate the general direction of movement of the container moving means (in this embodiment, the movement of the chassis 16) to reach the configuration represented by the next succeeding figure. The shafts 40A and 40B and their respective wheels 42A and 42B represent any selected pair of mutually adjacent shafts and associated wheels in the apparatus. Shaft 40C and its associated wheel 42C represent the next adjacent shaft and wheel combination on the opposite side of combination 40B, 42B from combination 40A, 42A. The dotted line path a, b, c, d illustrates the path traced by the center line of shaft 40B during its movement depicted in the sequence of FIGS. 4 through 8.

Figure 4:
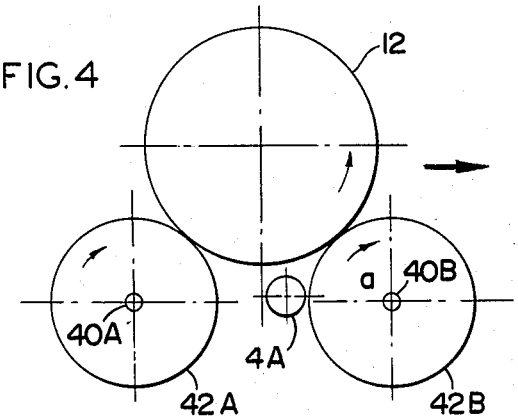
FIGS. 4 through 8 are schematic side elevational views of the container supporting and moving apparatus of this invention, along with a supported container, illustrating the manner of movement of such apparatus.

FIG. 4 depicts the initial position of the apparatus, in which the vertical actuating cylinder 32 is in the configuration as shown in FIG. 1, with its piston extended, but in which the horizontal actuating cylinder 34 is in a retracted configuration, unlike the extended configuration of FIG. 1. In this configuration a container 12 in the system is supported by its engagement with the wheels 42A and 42B. Relative rotational movement of those wheels 42A and 42B provides for tangential movement with respect to the cylindrical sidewalls of container 12 to effect rotation of the container in the manner indicated by the arrows. This rotation thus provides for agitation and stirring of the contents.

While the containers are carried by this apparatus, they are bathed by the flows of fluid 11 from the nozzles 10. In the apparatus of FIG. 1 the fluid flows 11 from the nozzles 10 adjacent the left hand portion of the apparatus may, if desired, be of high-pressure steam to heat the containers for sterilization of the contents within. The rotation provides for the desired agitation to achieve generally uniform heating of the contents. Subsequent nozzles may, if desired, provide for cooling flows of other fluids, such as air or water, to cool the containers 12 and their contents subsequent to the sterilization. If desired, these fluid flows may be of a refrigerated liquid. The sidewalls 6 and 6' serve to restrain the fluid flows 11 and keep them within the confines of the apparatus.

While the rotation of wheels 42, and thus of the container 12, continues, the control mechanism actuates appropriate valving to effect extension of the piston of horizontal actuating cylinder 34. Such extension urges the chassis 16 to the right in FIG. 1, in the direction of the bold arrow shown in FIG. 4. Because chassis 16 and its guide rail 18 are supported on the skidding wheels 20, such extension of the piston of cylinder 34 effects a horizontal movement of the chassis 16, and thus of the supporting shaft members 40 (40A and 40B in FIG. 4). This movement to the right is depicted by the dotted line between points a and b in FIG. 5. The position reached by such horizontal actuation is that depicted in FIGS. 1, 3 and 5. During this movement the rotation of wheels 42A and the related agitation of container 12 has continued.

Figure 5:
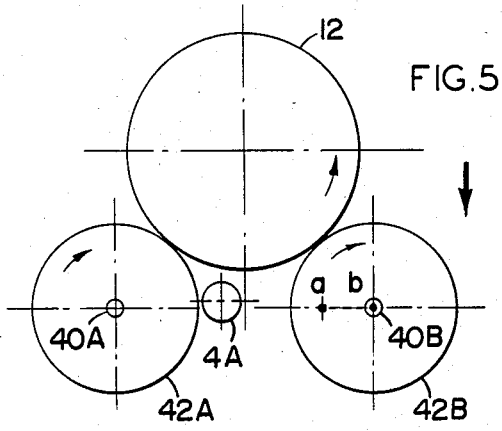

In this preferred embodiment the next movement of the container moving means is in a generally downward direction, as indicated by the bold arrow in FIG. 5. This is effected by the suitable control mechanism and valving effecting retraction of the piston of vertical actuating cylinder 32. Such retraction will thus move the vertical actuating arms 28, and their connected supporting arms 22 in a clockwise direction. The connecting members 30 extending between each of the vertical actuating arms 28 provide for simultaneous movement of all such arms 28 and support arms 22. This clockwise rotation thus causes a lowering of the skidding wheels 20 and thus of the supported chassis 16. During this actuation of cylinder 32 the horizontal actuating cylinder 34 has maintained its position of extension such that the lowering of chassis 16 and thus of wheels 42 (42A and 42B in FIGS. 4 through 6) moves in a slightly arcuate path but generally vertically downwardly. This path is illustrated by the dotted line between points b and c in FIG. 6.

As shown in FIGS. 4 and 5, the horizontal movement of the container moving means has been effected with the container supported above and thus out of engagement with the fixed support 4A. The horizontal movement between FIGS. 4 and 5 has served to move the container from a position in which the support 4A is to the right of the axis of the container 12 to one in which it is to the left of that axis, but still spaced below the container.

Figure 6:
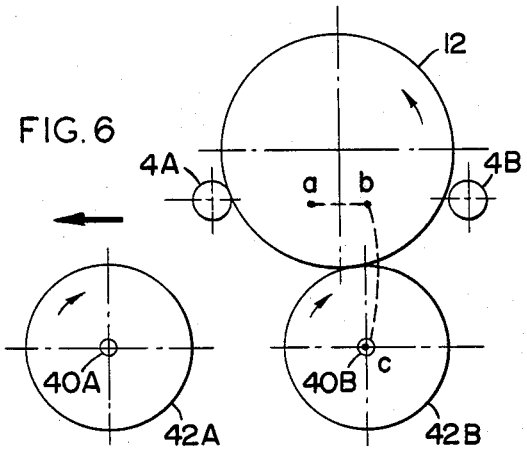
Figure 7:
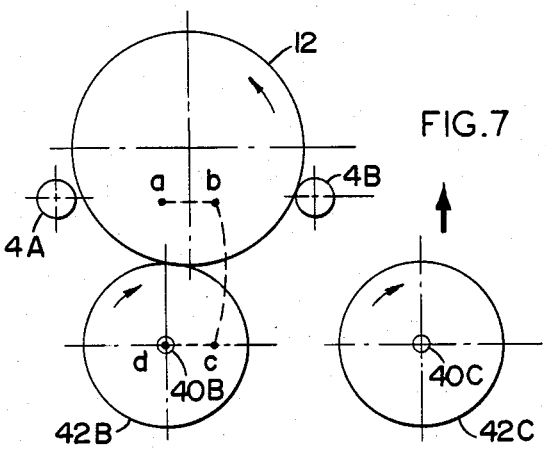

The generally vertically downward movement from the first vertical position illustrated in FIGS. 4 and 5 to the second, lower, vertical position illustrated in FIGS. 6 and 7 serves to bring the container 12 into engagement with the support 4A. In FIG. 6 the container is illustrated as being supported on the periphery of wheel 42B and support 4A. At this point, shown in FIG. 6, wheel 42B and its shaft 40B is positioned to the right of the axis of container 12, thus urging container 12 to the left against support 4A. It should also be noted that, upon initiation of the generally vertically downward movement rotation of the wheels 42 in this preferred embodiment is temporarily stopped, thus stopping rotation of the container 12 prior to its engagement with the support 4A.

When the container moving means, including the chassis 16 and its combinations of shafts 40 and wheels 42 reach the lower, second vertical position shown in FIG. 6, the hydraulic controller stops further descent and then initiates horizontal movement in the direction indicated by the bold arrow in FIG. 6. This is effected by actuation of an appropriate valve, causing horizontal actuator cylinder 34 to retract its piston. Preferably, this retraction by cylinder 34 is made at a substantially greater speed then the previous extension. This retraction effects the change in position illustrated between FIGS. 6 and 7, in which the center line of shaft 40B moves from position c to position d, as shown in FIG. 7. This movement of wheel 42B causes the point of engagement of that wheel with the container 12 to move from a point to the left of the axis of the container, as shown in FIG. 6, to a point to the right of the axis of the container, as shown in FIG. 7. This movement then urges the drum into engagement with support 4B as shown in FIG. 7.

Figure 8:
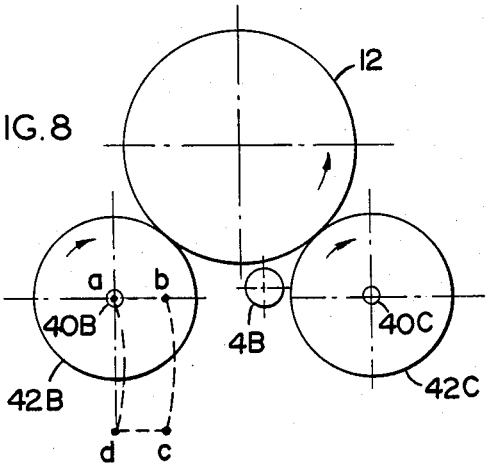

When the container moving means has been moved horizontally to the position illustrated in FIG. 7, the hydraulic controller halts further actuation of cylinder 34. At that time the control system then actuates appropriate valving to initiate extension of the vertical actuator cylinder 32 to begin the upward movement of the container moving means as indicated by the bold arrow in FIG. 7. Such movement thus rotates the arms 28 and 22 in the counterclockwise direction back to the position illustrated in FIGS. 1 and 3, and as illustrated in FIG. 8. Such movement raises the chassis 16 and thus the entire container moving means generally along the path indicated by the dotted line between points d and a in FIG. 8. Thus, the final position, as indicated in FIG. 8, is the same as the initial position illustrated in FIG. 4, with the container 12 again supported on the container moving means.

Because the point of contact between the container 12 and its supporting wheel 42B throughout this final lifting sequence has been to the left of the axis of container 12, the container is continually urged to the right. This urging results in the container, in FIG. 8, having been moved to the right and now being supported upon wheels 42B and 42C, one step to the right from the support in FIG. 4 on wheel 42A and 42B. With the container again supported on the container moving wheels 42, the automatic controlling apparatus again initiates actuation of rotational drive 46, thus effecting rotation of the wheels 42 and the container 12.

As a result of the roughly rectangular movement of the container moving means around the four-sided path a, b, c, d, illustrated in FIGS. 4 through 8, each container introduced into the apparatus may be sequentially moved along the path extending from the left side of the apparatus in FIGS. 1 and 3 to their respective right sides. Obviously, in the abbreviated apparatus of FIG. 3, having only a single pair of shaft and wheel combinations 40, 42, there would only be two such steps, whereas the extended apparatus of FIG. 1 would have a large plurality of such steps.

In the apparatus of FIG. 1 the initial fluid spray heads 10 may suitably provide for sterilization of the container contents, with subsequent spray heads providing for cooling of the container and its contents. In the abbreviated apparatus of FIG. 3, which could suitably be used in a highly confined space the same effect could be obtained by sequentially switching the types of fluid 11 flowing through the plumbing 8 and spray heads 10 from an initial heated sterilizing fluid to a subsequent cooling fluid.

FIGS. 9 through 12 illustrate in schematic form a variation of a portion of the apparatus of this invention. In these figures the radially enlarged portions of the shaft 40 are in the form of pairs of eccentrically mounted wheels 42 and 42'. Suitably, the eccentrically mounted wheels are offset in diametrically opposed directions, and preferably with all such wheel pairs being maintained in coordinate positions.

Figure 9:
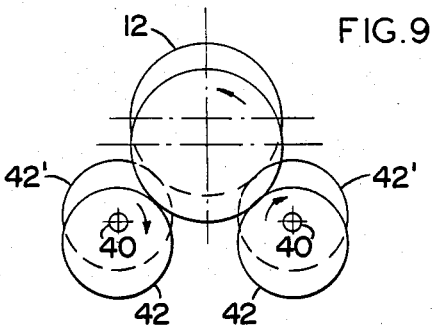
FIGS. 9 through 12 are schematic side elevational views, corresponding respectively to FIGS. 4 through 7, of a variation of the apparatus of FIG. 1 in which container rotating wheels are eccentrically mounted.
Figure 10:
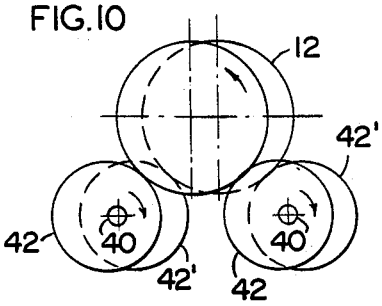
Figure 11:
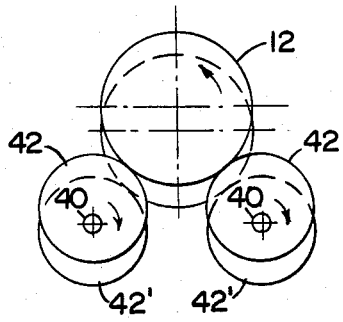
Figure 12:
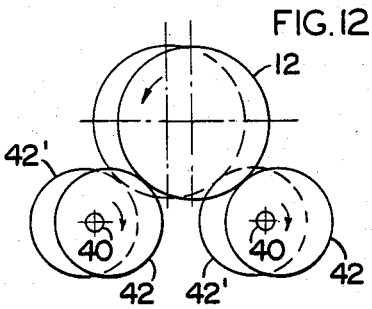

As shown in FIG. 9, the forward wheels 42 on each shaft 40 in the position of FIG. 9 are displaced downwardly, with the rearward wheels 42' displaced upwardly. This supports the container 12 in a position in which the rear of the container is also angled upwardly. As the shafts 40 continue to rotate in their clockwise direction in this embodiment, the front wheels 42 will thus rotate first to a position in which the offset is to the left, as shown in FIG. 10. At this same time the rear wheels 42' will be offset to the right, thus moving the rear of the container 12 to the right with respect to the front of the container. As shown in FIGS. 11 and 12, continued rotation of the shafts 40 will continue to rotate the container to a position with the front of the container raised with respect to the rear and then offset to the right with respect to the rear, as shown in FIGS. 11 and 12. Thus, by the use of the eccentrically mounted wheels 42 and 42' the container 12 will not only be rotated about its axis but will also be agitated in a generally conical manner. This agitation is beneficial with certain products carried within the container to insure a more rapid heat transfer throughout those contents from the fluid flow directed onto the container.

As should be apparent, the apparatus of this invention provides numerous benefits not available in the prior art. Among these benefits are the provision of continuous processing of containers or drums, with sequential such containers being introduced into one end of the apparatus and thermally conditioned such containers being removed from the discharge end. It should also be apparent that the apparatus of this invention utilizes parts of substantial strength, with no delicate moving parts to compromise the reliability of the apparatus. Significantly, this apparatus is configured in such a manner that different sizes of containers may be carried and thermally conditioned thereby without making any changes in the apparatus. Correspondingly, the apparatus may even be utilized with a plurality of types or sizes of containers being carried therethrough simultaneously. Additional benefits will readily occur to those skilled in the art.

While the foregoing describes several preferred embodiments of the apparatus of this invention and its method of operation, this description is to be considered only as illustrative of the principles of the invention and not to be limitative thereof. Because numerous variations and modifications, all within the scope of the present invention, will readily occur to those skilled in the art, the invention is to be limited solely by the claims appended hereto.

What is claimed is:

1. Apparatus for moving and thermally conditioning generally cylindrical containers, comprising mounting means;

container support means fixedly connected to said mounting means for selectively engaging each such container at predetermined positions with the cylindrical axis of such container in a generally horizontal position;

container moving means carried by said mounting means and being selectively movable relative to said container support means between a first vertical position carrying such a container out of engagement with said supporting means and a second vertical position permitting engagement between such container and said supporting means, said container moving means comprising at least two adjacent members, the mutually closest portions of which are spaced apart a horizontal distance less than the diameter of such a container to be moved thereby and positioned below the axis of such container and being movable relative to the cylindrical sidewalls of such a container in directions generally tangential to the container sidewalls at the points of contact therewith, whereby the relative motion between the container and the members, when in carrying engagement therewith, will effect a rotational movement of the container about its axis; and means for effecting predetermined heat flow relative to such a container to change the temperature of the container by a predetermined amount.

2. The apparatus of claim 1 wherein said container moving means spaced members each comprise a rotatably mounted and driven shaft member having portions configured to rollingly engage a portion of the cylindrical sidewall of such a container.

3. The apparatus of claim 2 wherein said rotatably mounted and driven member comprises a plurality of radially enlarged wheel means spaced apart along said shaft means such that said wheel means supportingly engage the container sidewall at axially spaced locations.

4. The apparatus of claim 3 wherein said axially spaced locations are proximal the respective ends of said container.

5. The apparatus of claim 4 wherein said wheel means are generally concentric with said shaft means.

6. The apparatus of claim 4 wherein said wheel means are eccentric to said shaft means.

7. The apparatus of either of claims 5 and 6 wherein said wheel means each include a container supporting portion for supportingly engaging portions of the container sidewall and a radially outwardly extending flange portion positioned to be axially outside the respective end of such container and extending radially inwardly of the container sidewall, whereby the flange means serve to restrain axial movement of the container during its engagement with the container moving means.

8. The apparatus of claim 1 wherein said container moving means further comprises means for effecting said relative movement of said container supporting means and said container moving means in a generally vertical direction between said first vertical position and said second vertical position.

9. The apparatus of claim 8 further comprising means for effecting relative movement between said container moving means and said container supporting means in a generally horizontal direction generally transverse to the axis of such a container to be carried thereby.

10. The apparatus of claim 9 wherein said container moving means further comprises chassis means for carrying said spaced members, said chassis means being connected to said mounting means for said relative vertical movement and said relative horizontal movement.

11. Apparatus according to claim 9 wherein said horizontal movement effecting means provides for said horizontal relative movement in a first predetermined direction when said container moving means is in said first vertical position relative to said support means.

12. Apparatus according to claim 11 wherein said horizontal movement effecting means provides for said horizontal relative movement in a second direction generally opposite said first direction when said container moving means is in said second vertical position relative to said support means.

13. Apparatus according to claim 1 further comprising container including means positioned at a first side of said apparatus for receiving such a container to be thermally conditioned, with such container being oriented with its cylindrical axis in a generally vertical direction, and reorienting such container to render its axis generally horizontal and then introducing such container into engagement with said container moving means.

14. Apparatus according to claim 13 further comprising container removal means positioned at a second side of said apparatus for receiving a thermally conditioned such container from said container moving means and then reorienting such container to render its axis generally vertical for subsequent removal from said apparatus.

15. Apparatus according to claim 1 wherein said heat flow effecting means comprises means for directing a fluid flow of predetermined temperature toward said container moving means in such a manner as to impinge upon any such container carried thereby.

16. Apparatus for moving and thermally conditioning generally cylindrical containers, comprising:

mounting means;

container support means fixedly connected to said mounting means for selectively engaging each such container at predetermined positions with the cylindrical axis of such a container in a generally horizontal position;

container moving means comprising chassis means mounted to said mounting means for movement in both a generally horizontal direction and a generally vertical direction;

actuating means for selectively effecting said movement of said chassis means;

container engaging and rotating means mounted to said chassis means for selectively engaging the cylindrical sidewall of such a container for movement with said chassis means generally vertical movement between a first vertical position carrying such a container out of engagement with said supporting means and a second vertical position permitting engagement between such a container and said supporting means, said container engaging and rotating means being selectively movable relative to the cylindrical sidewalls of such a container in directions generally tangential to such sidewall at the point of engagement therewith, whereby such tangential relative movement between such a container and the container engaging and rotating means will effect a rotational movement of the container about its axis; and means for effecting predetermined heat flow relative to such a container to change the temperature of the container by a predetermined amount.

17. Apparatus according to claim 16 wherein said container engaging and rotating means comprises at least two adjacent members, the mutually closest portions of which are spaced apart a horizontal distance less than the diamter of such a container to be engaed thereby and positioned below the axis of such container.

18. Apparatus according to claim 17 further comprising drive means operatively connected to said members for imparting thereto said selective movement generally tangential to a container sidewall engaged thereby, whereby the rotational movement of such a container about its axis will be effected.

19. Apparatus according to claim 17 wherein said container engaging and rotating means members comprise shafts having substantially parallel axes and being rotatably mounted to said chassis means, each said shaft having a plurality of radially enlarged portions positioned for said engagement with a container to be moved by said apparatus.

20. Apparatus according to claim 19 further comprising means for selectively and rotationally driving said shafts.

21. Apparatus according to claim 19 wherein said radially enlarged portions comprise a pair of wheels affixed to each shaft and having radially outwardly extending flange portions and being positioned such that said flange portions are axially outside the axial ends of such a container engaged thereby, whereby the flange portions restrain axial movement of such a container.

22. Apparatus according to claim 21 wherein said wheels are eccentric to their respective said shafts, whereby rotation of the shafts will impart an agitating movement to any such container supported thereupon.

23. Apparatus according to claim 16 wherein said chassis movement actuating means comprises vertical actuating means for selectively effecting said generally vertical movement of said chassis means between said first and second positions in a reciprocating manner and horizontal actuating means for selectively effecting said generally horizontal movement of said chassis means in a reciprocating manner, whereby sequential actuation of the vertical actuating means and the horizontal actuating means serves to effect movement of the chassis means around a four-sided path.

24. Apparatus according to claim 23 wherein said horizontal actuating means provides for such generally horizontal movement of said container engaging and rotating means at said second vertical position that the point of engagement with such a container by said container engaging and rotating means is moved from a position on one side of a vertical plane coincident with the axis of such an engaged container to a position on the opposite side of said plane, whereby subsequent movement of the container engaging and rotating means from the second vertical position to the first vertical position will urge movement of such container in a generally horizontal direction.

25. Apparatus according to claim 16 further comprising container introducing means positioned at a first side of said apparatus for receiving such a container to be thermally conditioned, with such container being oriented with its cylindrical axis in a generally vertical direction and for reorienting such container to render said axis generally horizontal and then introducing such container into engagement with said container moving means.

26. Apparatus according to claim 25 further comprising container removal means positioned at a second side of said apparatus generally opposite said first side, for receiving a thermally conditioned such container from said container supporting means and said container moving means and then reorienting such container to render its axis generally vertical for subsequent removal from said thermally conditioning apparatus.

27. Apparatus according to claim 16 wherein said heat flow effecting means comprises means for directing a fluid flow of predetermined temperature toward said container engaging and rotating means in such a manner as to impinge upon any such container engaged thereby.

28. Apparatus according to claim 27 wherein said fluid directing means comprises a plurality of nozzle means positioned to direct their respective fluid flows sequentially upon such an engaged container and wherein at least one of said fluid flows is of a temperature different from that of another said fluid flow.

* * * * *

UNITED STATES PATENT AND TRADEMARK OFFICE

CERTIFICATE OF CORRECTION

PATENT NO. : 4,505,670

DATED : March 19, 1985

INVENTOR(S) : Jesus A. Silvestrini; Juan C. Morsucci

It is certified that error appears in the above-identified patent and that said Letters Patent are hereby corrected as shown below:

column 9, claim 13, line 2, change "including" to -- introducing --.

Signed and Sealed this

*Sixteenth* Day of *July 1985*

[SEAL]

*Attest:*

DONALD J. QUIGG

*Attesting Officer* *Acting Commissioner of Patents and Trademarks*